United States Patent [19]

Joyce

[11] Patent Number: 4,727,608

[45] Date of Patent: Mar. 1, 1988

[54] FITTED BED SHEET AND METHOD OF MAKING SAME

[76] Inventor: William R. Joyce, P.O. Box 489, Fairview, N.C. 28730

[21] Appl. No.: 891,208

[22] Filed: Jul. 28, 1986

[51] Int. Cl.[4] ..... A47G 9/04; A47G 9/02

[52] U.S. Cl. ..... 5/497; 5/496; 38/140; 112/262.1; 24/266; 428/99

[58] Field of Search ..... 5/492, 496, 498, 499, 5/482; 428/99; 297/219; 38/140

[56] References Cited

U.S. PATENT DOCUMENTS

| | | | |
|---|---|---|---|
| 1,156,939 | 10/1915 | Smith . | |
| 1,169,607 | 1/1916 | Blenis . | |
| 2,161,448 | 6/1939 | Bishop . | |
| 2,528,313 | 10/1950 | Kessler . | |
| 2,569,627 | 10/1951 | Black . | |
| 2,700,778 | 2/1955 | Syracuse . | |
| 2,707,314 | 9/1957 | Larkin . | |
| 2,804,632 | 9/1957 | Ford . | |
| 2,814,135 | 8/1954 | Freeman | 38/66 |
| 2,817,391 | 12/1957 | Zacks . | |
| 2,886,833 | 5/1959 | Enger . | |
| 2,942,280 | 6/1960 | May, Jr. . | |
| 2,963,715 | 12/1960 | Young . | |
| 2,994,094 | 8/1061 | Hester . | |
| 3,020,566 | 2/1962 | Anderson et al. . | |
| 3,049,826 | 8/1962 | Goldsmith | 38/140 |
| 3,056,245 | 10/1962 | Baum et al. . | |
| 3,114,156 | 12/1963 | Cobb . | |
| 3,273,175 | 9/1966 | Anderson et al. . | |
| 3,321,782 | 5/1967 | Hrubecky et al. . | |
| 3,438,068 | 4/1969 | Anderson et al. . | |
| 3,681,795 | 8/1972 | Palenske et al. | |
| 3,694,832 | 10/1972 | Jamison . | |
| 3,733,724 | 5/1973 | Davis | 38/140 |
| 3,900,909 | 8/1975 | Monier et al. . | |
| 3,906,559 | 9/1975 | Bahr . | |
| 3,962,739 | 6/1976 | Crockett . | |
| 4,412,369 | 11/1983 | Carnaghi | 24/266 |
| 4,461,049 | 7/1984 | Hammond | 5/498 |
| 4,495,233 | 1/1985 | Bassetti | 428/81 |
| 4,512,049 | 4/1985 | Henry | 5/417 |
| 4,642,826 | 2/1987 | Bassetti | 5/496 |

FOREIGN PATENT DOCUMENTS

| | | | |
|---|---|---|---|
| 2133052 | 7/1984 | United Kingdom | 5/496 |

*Primary Examiner*—Alexander Grosz

*Attorney, Agent, or Firm*—Luedeka, Hodges & Neely

[57] ABSTRACT

A fitted bed sheet and a method of making the sheet from a rectangular blank of sheet material are disclosed. Resiliently extensibile strips having catches positioned at predetermined locations along the strips are enclosed within longitudinal, open-ended sheaths extending along opposite marginal edges of the blank. One end of each strip extends out of the open end of the sheath and the other end is anchored to the sheath. The blank is folded inwardly upon itself along fold lines to dispose the sheaths in a spaced-apart, generally parallel relationship on the blank to form laterally opposed double-layered panels. Seams are then formed diagonally across the corners of the panels from adjacent the end of the sheaths to points along the fold lines so that a fitted sheet is formed. When the sheet is placed on a mattress, it is drawn into fitting engagement by pulling on the extended ends of the extensible strips and placing the catches over edges of the open ends of the sheaths.

8 Claims, 13 Drawing Figures

FITTED BED SHEET AND METHOD OF MAKING SAME

The present invention relates to bed sheets and more specifically relates to fitted bed sheets and a method of making the sheets which is adapted for substantially continuous, automated production of fitted sheets having a substantially planar configuration.

Most fitted bed sheets which include panels to cover the upper and side surfaces of a mattress are held on the mattress by elastic inserts at the corners which cause the corner areas to pucker or gather excessively when the sheet is not on the mattress. This makes the sheet difficult to launder and makes it very bulky for storage. Further, because of the necessity of incorporating the elastic in the corner it has not been commercially practical to produce them on an automated production line.

One attempt to solve the problems is illustrated by British Pat. No. 2,133,052 A. This patent discloses the incorporation, in the corners of the sheet, of an elastic draw string which is anchored at each end in a sheath formed of the sheet material. The sheath has an opening intermediate its ends through which a loop of the draw string is pulled to fit the sheet around the corner of the mattress. The drawstring is then tied or otherwise fastened to hold the sheet corner in position on the mattress. This is not practical in use because of the difficulty of "fishing" the loops of the draw strings out of the opening in the sheaths. Also, the provision of the opening is not practical with known equipment on an automated production line.

Accordingly, it is an object of this invention to provide an improved fitted sheet whose corners can be brought into a fitting relationship with the corners of the mattress and releasably held in that relationship with a minimum of difficulty. It is also an object of this invention to provide a method of making a sheet of the character described which can be carried out on an automated production line.

Other objects and advantages of the present invention will be readily appreciated by those of ordinary skill in the art as the same becomes better understood by reference to the following detailed description when considered in conjunction with the accompanying drawings in which:

FIG. 1*a* illustrates a preferred form of a fitted bed sheet in accordance with the present invention fitted onto a mattress;

FIG. 1*b* illustrates the ungathered corner shape of the sheet on the mattress prior to fitting the sheet onto the mattress;

FIG. 2*a–h* illustrate diagramatically a preferred form of the method of the present invention showing steps in the production of the fitted bed sheet from a rectangular blank of sheet material;

Figure 5A:
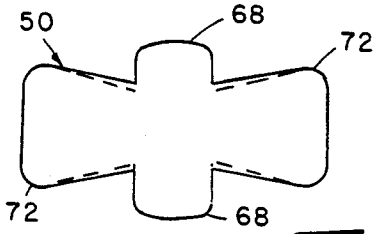
Figure 5B:
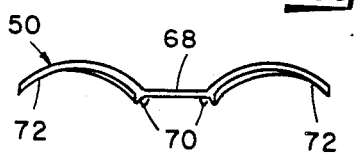

FIG. 5*a* is a plan view of a preferred form of a catch employed in fitting the sheet;

FIG. 5*b* is a front view of the catch illustrated in FIG. 5*a;*

Figure 6A:
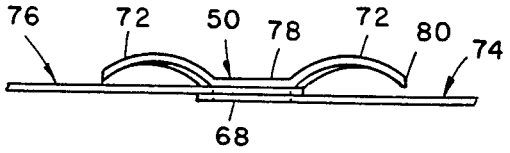
Figure 6B:
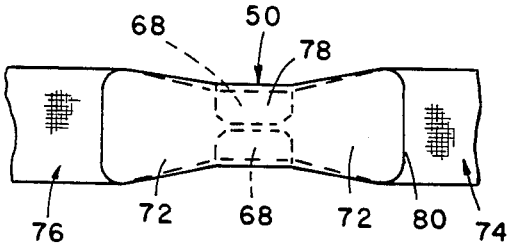

FIG. 6*a* is an elevational view of the catch of FIGS. 5*a* and 5*b* applied to the extensible strip;

FIG. 6*b* is a plan view of the catch and extensible strip of FIG. 6*a;*

Figure 7A:
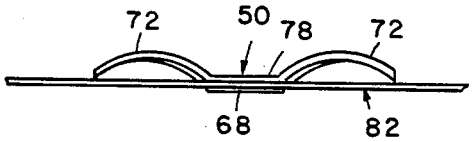
Figure 7B:
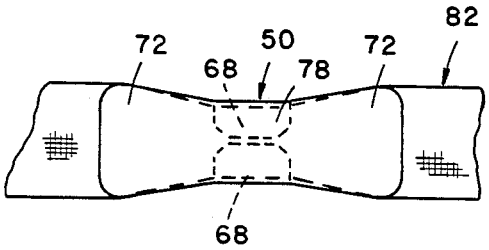

FIG. 7*a* is an elevational view showing location of the catch in an alternate embodiment;

FIG. 7*b* is a plan view of the catch illustrated in FIG. 7*a;*

Figure 8:
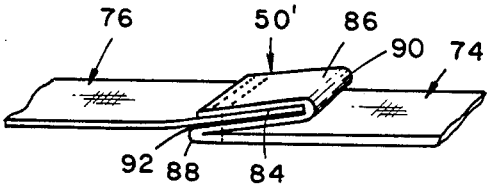

FIG. 8 is a perspective view of an alternate catch; and

Figure 9:
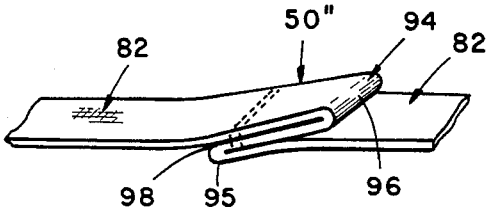

FIG. 9 is a perspective view of another alternate catch.

Figure 1A:
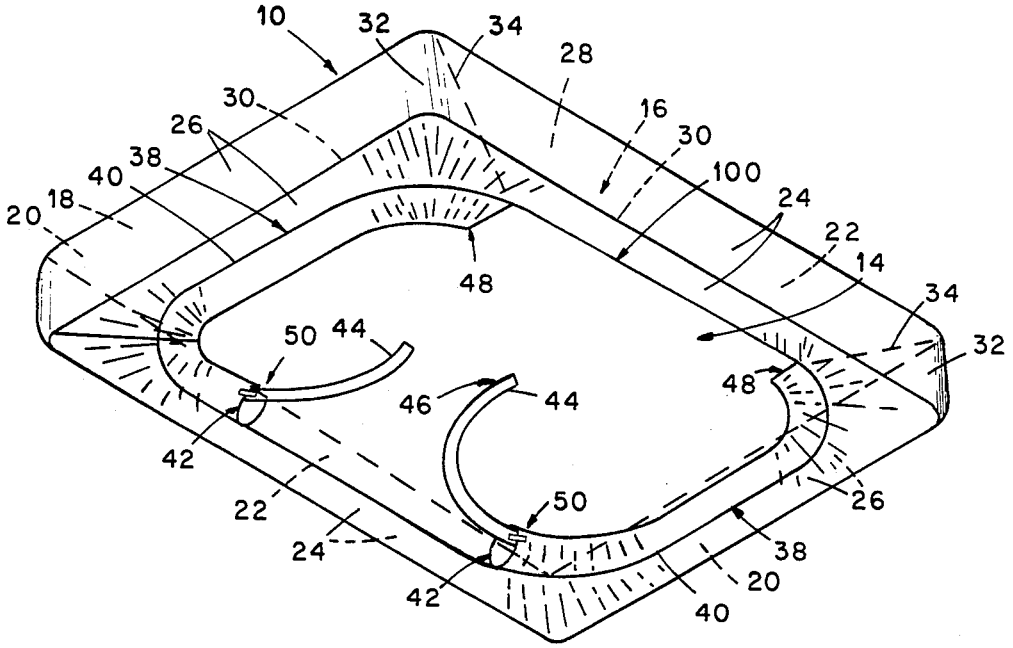
Figure 1B:
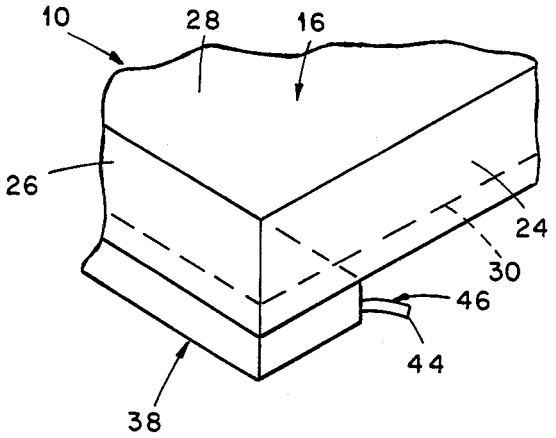
Figure 2:
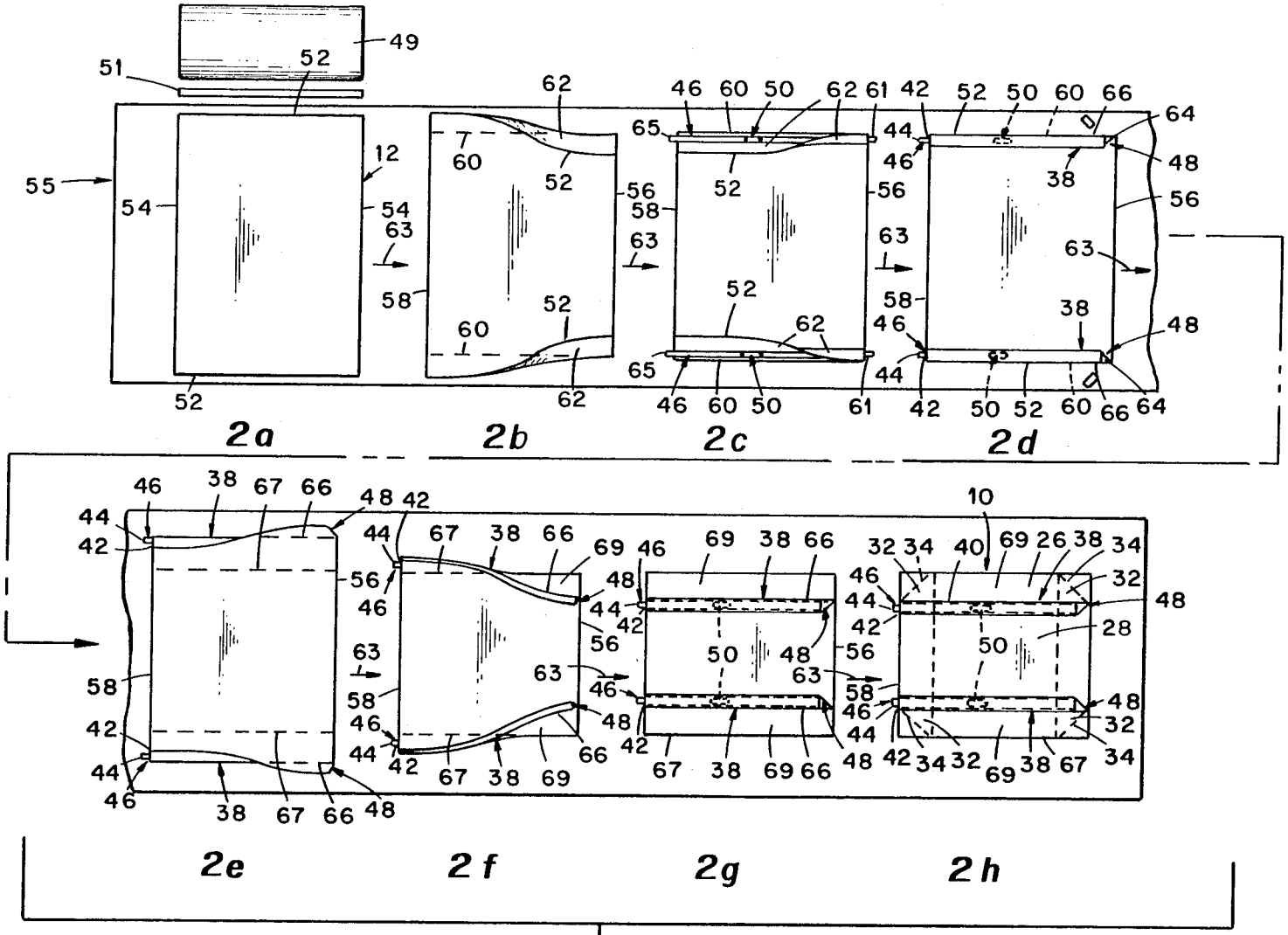
Figure 4:
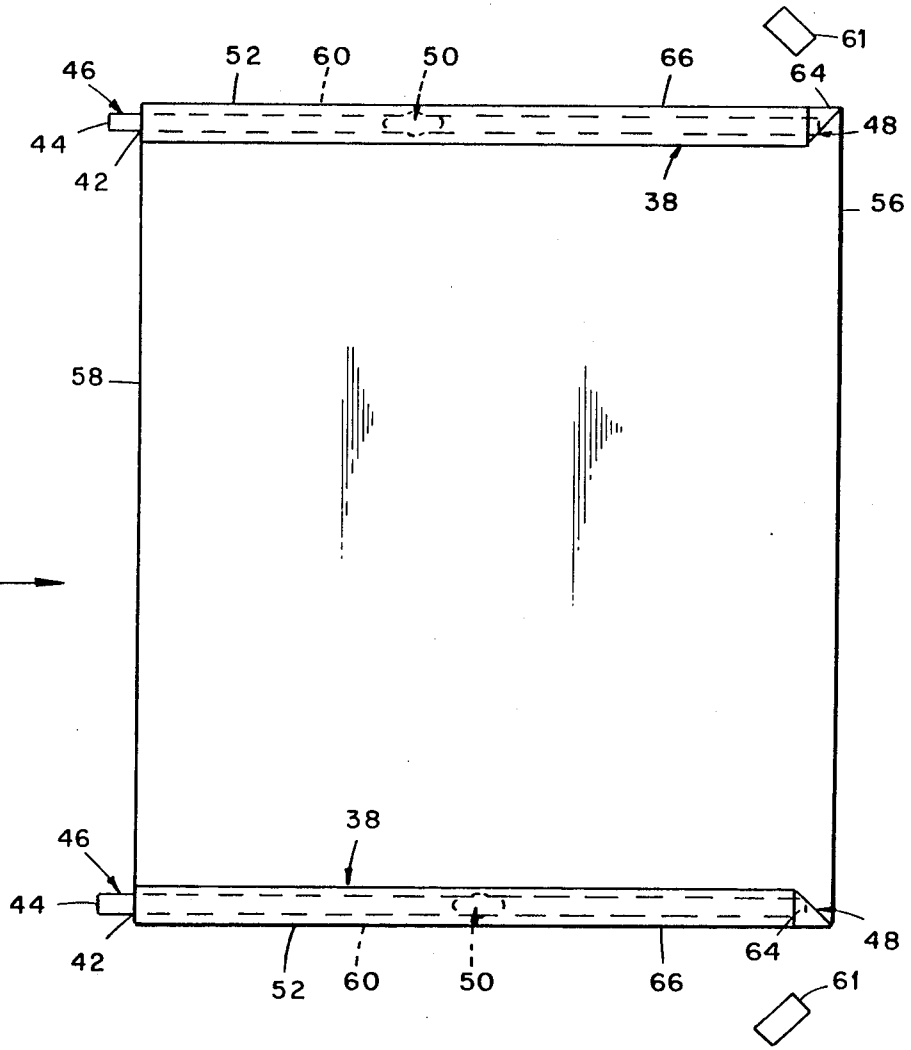
FIG. 4 is an enlarged view of the sheet in FIG. 2*d;*
Figure 3:
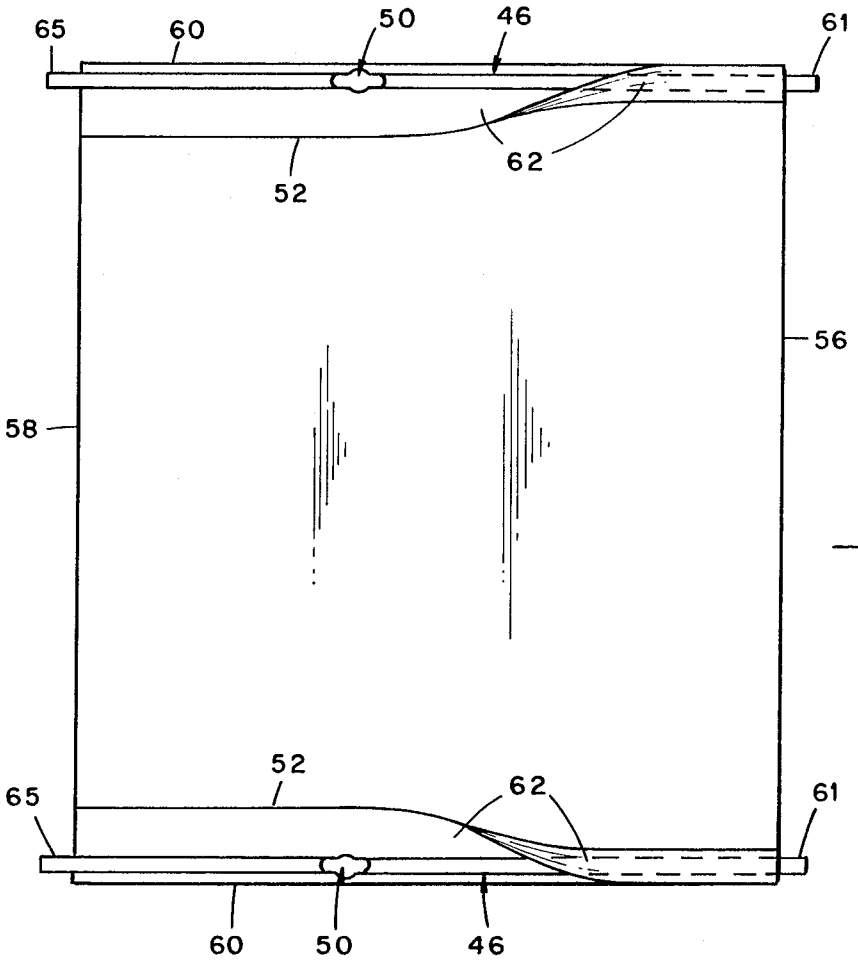
FIG. 3 is an enlarged view of the sheet in FIG. 2*c;*

Referring now to the drawings in which like reference characters refer to like or similar parts throughout the several views, a fitted bed sheet 10 is illustrated in FIGS. 1*a* and 1*b* including various features of the invention and, as described below with reference to FIGS. 2 through 4, is formed from a rectangular blank 12 of textile sheet material.

For purpose of clarity, the construction of the sheet 10 hereinafter will be described with the sheet 10 placed over a mattress 14. A web of sheet material 16 is dimensioned to fittingly cover a top 18, opposed ends 20, and opposed sides 22 of the mattress 14. Opposed side panels 24 and opposed end panels 26 of the web 16 are integral with a top panel 28 thereof, and extend downwardly from the top panel 28 beyond a lower edge 30 of the mattress 14. Triangular portions 32 of the end panels 26 extend around the vertical corners of the mattress 14 and are attached along diagonal sew lines 34 to the side panels 24. Opposed tubular sheaths 38 extend along bottom edges 40 of the end panels 26 and have open ends 42, out of which extend free ends 44 of resiliently extensible strips 46. The strips 46 are anchored to the sheaths 38 at closed ends 48 of the sheaths 28 and are slidably movable therein. Preferably, as illustrated, the open ends 42 of the sheaths 38 are on the same side of the sheet 10 to facilitate access to the free ends 44 of the strips 46 from the same side of the mattress 14. Catches 50 are located at a predetermined position intermediate the opposite ends of each of the strips 46 for detachably attaching the strips 46 to the sheaths 38 adjacent their open ends 42.

The sheet 10 is drawn into fitting engagement with the mattress 14 by pulling on the free ends 44 of the strips 46 to resiliently extend the strips 46 in the sheaths 28 which gathers the corners of the sheet 10 inwardly of the bottom of the mattress 14, and employing the catches 50 to attach the strips 46 in their extended configuration to the open ends 42 of the sheaths 38. Thereafter, releasing the free ends 44 of the strips 46 causes the strips 46 to contract somewhat within the sheaths 38 further gathering the corners of the sheet 10 inwardly of the bottom of the mattress 14 across its end. The attachment of the strips 46 to the open ends 42 of the sheaths 38 by the catches 50 holds the strips 46 in an extended, tensioned configuration to maintain the sheet 10 in position on the mattress 14.

The following is a description of a preferred method of manufacturing the fitted sheet 10 described above. The method includes sequential folding and sewing steps to be described in more detail below. It will be appreciated that the preferred forms of the method are particularly suitable for continuous, automated production of fitted sheets 10 utilizing known conveying, folding, and sewing apparatus available in the textile industry.

Referring now to FIG. 2, there are shown various steps in a preferred method of producing the fitted bed sheet 10 from the blank 12. Blanks 12 are cut from a length of sheet material, such as cotton sheeting. Preferably, as shown in FIG. 2*a*, the sheeting is drawn from a roll 49 and cut at cut off station 51 at equal intervals to form the blanks 12 which are then conveyed flat with the cut edges 52 leading and trailing onto a conveyor 55. On the conveyor 55, the direction of movement is such that selvedge edges 54 of the blanks 12 are the leading and trailing edges 56 and 58, respectively, as the blanks 12 are moved through the part of the process illustrated in FIGS. 2*b* through 2*h*.

Reference is now had to FIGS. 2*b* through 2*d* where there is illustrated a preferred method for forming the sheaths 38 and inserting and securing the strips 46. FIG. 2*b* diagrammatically illustrates the folding station at which the cut edges 52 of the blank 12 are folded inwardly along a pair of longitudinal fold lines 60 which are generally equally spaced from, and generally parallel to, the cut edges 52 of the blank 12 to form opposed, folded over sheath panels 62. The folding is accomplished while the blank 12 is moving in the direction indicated by the arrows 63 using folding shoes, rolls or the like, positioned on the conveyor 55. The panels 62 preferably have a width slightly greater then twice the width of the strips 46. FIG. 2*c* diagramatically illustrates the strip feeding station and the second folding station. The strips 46 are fed onto the sheath panels 62 from a source (not shown), such as from spaced-apart rolls of resiliently extensible strips 46 with the catches 50 having been previously located on the strip material at longitudinally spaced-apart intervals in a manner to be described more fully below. Means (not shown) are provided to cut the strip material into lengths as it is fed onto the panels 62 so that a small portion of each strip 46 extends beyond the leading edge 56 of the blank 12, as at 61, and rearward of the trailing edge 58 of the blank 12, as at 65. The lateral location at which the strips 46 are fed onto the panels 62 is predetermined and maintained such as by optical scanning techniques so as to enable an outward folding over of the sheath panels 62 upon themselves to cover the strips 46 and catches 50 as shown in FIG. 2*c* and FIG. 3.

FIGS. 2*d* and 4 diagramatically illustrate the sewing station. The leading corner 64 of each sheath 38 is picked up and folded over diagonally with the portion 63 of the strip 42 extending beyond the marginal edge of the sheet just prior to sewing edge seams 66 along the folded over sheath panels 62. The folded-over sheath panels 62 are then sewn together with the edge seams 66 located along the outer border, generally along the fold lines 60, forming the sheaths 38 and enclosing the strips 46 and catches 50. As illustrated in FIG. 4, the initial sewing of the seams 66 across the folded over corners 64 forms the closed ends 48 of the sheaths 38 and anchors the strips 46 to the sheaths 38 at the closed ends 48. This is due to the fact that the seam 66 will extend across the folded over ends of the strips 46 contained within the corners 64 of the sheaths 38 as shown in FIG. 3, providing for attachment of the end of the strips 46 to the sheaths 38 where the corners 64 are folded over. As the sewing machine forms the seam 66 it cuts off the portion 63 which extends beyond the seam.

FIG. 2*e* diagrammatically illustrates a folding station at which the sheaths 38 enclosing the strips 46 and catches 50 are folded away from the center of the blank 12. Thereafter, the marginal edges of the blank 12 are folded inwardly lengthwise at a folding station as in FIG. 2*f* along a pair of spaced-apart, generally parallel, fold lines 67 to form double-layered panels 69. The position of the fold lines is determined by the depth of the mattress to be covered so that the panels 69 will fit over the side of the mattress 14.

As shown in FIG. 2*g*, the panels 69 extend inwardly from the fold lines 67 to the sheaths 38. The layers of the panels 69 are then joined together along the sew lines 34 illustrated in FIG. 2*h* which extend generally diagonally across each corner of each panel 69 from adjacent the ends of the sheaths 38 to points along the fold lines 67, whereupon the fitted sheet 10 is formed. The sew lines 34 are conveniently formed using diagonally movable sewing machines (not shown) mounted on opposite sides of the conveyor 55 operable to be activated upon movement thereunder of the blank 12 to move along predetermined lines corresponding to the sew lines 34.

The sheet 10 may then be folded inside-out to direct the cut fabric edges outside of the sew lines 34 toward the inside of the sheet 10 after which the sheet 10 is folded and packaged.

One important consideration in manufacturing the sheet 10 is addressed in the positioning of the catches 50 in the sheaths 38. In this regard, a position is selected to insure that the catches 50 are drawn into the sheaths 38 when the strips 46 are relaxed. Otherwise, the catches 50 could become entangled or hang on portions of other sheets during laundry operations, etc. However, the catches 50 should be close enough to the open ends 42 of the sheaths 38 so that extension of the strips 46 after the fitted sheet 10 is placed on the mattress 14 will permit attachment of the catches 50 at the the open ends 42 of the sheaths 38 with a suitable degree of tension being retained in the strips 46 after the free ends 44 thereof have been released to hold the sheet 10 in fitting engagement with the mattress 14. Of course, this predetermined location of the catches 50 will depend on the type of material used to construct the strips 46 including its elasticity, and on the required degree of snugness for the sheet.

Referring now to FIGS. 5*a* and 5*b*, a preferred form of the catch 50 is illustrated prior to application of the catches 50 on the strips 46. Opposed, laterally projecting tabs 68 are configured downwardly projecting teeth 70. Opposed, longitudinally projecting tabs 72 extend generally perpendicularly from the lateral tabs 68 and, asa shown in FIG. 5*b*, are wing-like viewed from the side. The catches 50 are preferably formed from a rust-proof metal such as stainless steel or aluminum so they will withstand laundering operations and the associated use of detergents, etc.

As shown in FIGS. 6*a* and 6*b*, lateral tabs 68 are bent inwardly upon themselves to enclose overlapped lengths of non-elastic and elastic tape 74 and 76, respectively, between the lateral tabs 68 and a center portion 78 of the catch 50 in clamp-like engagement, the teeth 70 having been forced into and through the overlapped portion of the tapes 74 and 76 to firmly attach the tapes 74 and 76 together. And, as shown in FIG. 2*c*, the length of elastic tape 74 extends forwardly of the catch 50 and is anchored to the sheath 38 according to the description of FIG. 2*d* and FIG. 4 as described above. The non-elastic tape 76 extends rearwardly of the catch 50 and out of the open end 42 of the sheath 38 and is accessible for being grasped to resiliently extend the strip 46 within the sheath 38. This joining together of lengths of elastic and non-elastic tape 74 and 76 constitutes a preferred construction of the resiliently extensible strip 46. The tapes 74 and 76 are preferably relatively thin with a width of about one half to three quarters of an inch. It will be appreciated that this configuration provides a strip 46 which dries relatively quickly during laundering and is less likely to rot or weaken as are cords and strings.

In applying the sheets 10 to the mattress 14 as shown in FIG. 1a, the strips 46 are extended within the sheaths 38 until the catches 50 are located adjacent the open ends 42 of the sheaths 38 to cause a gathering of the corners of the sheet 10 inwardly of the bottom of the mattress 14. The longitudinally projecting tabs 72 are then located over the circumferential edges of the openings 42 of the sheaths 38 whereupon the sheet 10 is held on the mattres 14 as described. Also, as shown in FIG. 6a, a leading edge 80 of each tab 72 is elevated somewhat above the surface of the elastic tape 74 when the latter is extended, permitting easier placement of the tab 72 of the catch 50 over the edge of the opening 42.

It will be appreciated that removal of the sheet 10 from the mattress 14 is easily accomplished by further extending the strips 46 within the sheaths 38 to remove the catches 50 from the edges of the openings 42 of the sheaths 38, and then releasing the strips 46, whereupon the resiliency of the strips 46 draws them back into the sheaths 38. In so doing, care is taken to insure that the tabs 72 do not again engage the edges of the openings 42 as the catches 50 move into the sheaths 38.

Construction of the fitted sheet 10 according to the preferred forms of the present method produces a sheet which is easily secured on the mattress 14, and removed therefrom, without the necessity of tying strings, etc. The simple act of pulling on the free ends 44 of the strips 46 accomplishes quick placement of the sheet 10 on the mattress and subsequent removal, and is convenient since both ends 44 of the strips 14 are located on the same side of the sheet 10. Also, the elasticity of the strips 46 causes them to be drawn back into the sheaths 38 when the catches 50 are detached from the sheaths 38 isolating the catches 50 during laundering operations to prevent them from hooking onto or becoming entangled with other items. And it is not necessary to sew into or otherwise provide reenforcement around the openings 42 of the sheaths 38, since the circumferential edges of the openings 42 are part of the original selvedge edges 54 of the blank 12 and thus have incorporated therein the additional structural integrity of the selvedge construction.

Referring now to FIGS. 7a and 7b, an alternate form of extensible strip includes a single, continuous length of elastic tape 82 to which is attached at predetermined locations the catches 50 as described above with reference to FIGS. 6a and 6b. This alternate form of the strip offers the advantage of being simpler to manufacture, since the overlapping step of FIG. 6a is avoided. However, where the part of the strips extending from the catches 50 to the openings 42 of the sheaths 38 is elastic, more pulling of the free ends 44 of the strips will be required due to the elongation of that portion of the strips induced by the pulling force. Thus, while in some applications the alternate form of the strips will offer advantages, especially in economics, the advantage of having a substantially non-elastic portion 76 as described in FIGS. 6a and 6b is appreciated when it is realized that the non-elastic portion 76 will not elongate when the free ends 44 of the strips 46 are pulled to draw the fitted sheet 10 into fitting engagement on the mattress 14.

Considering now FIGS. 8 and 9, alternate forms of the catch 50 are illustrated, FIG. 8 showing a catch 50' for use when lengths of elastic tape 74 are used with strips of substantially non-elastic tape 76, and FIG. 9 showing a catch 50" for use with the single, continuus length of elastic tape 82. Referring to FIG. 8, it is seen that the catch 50' is preferably constructed by sandwiching an end portion 84 of the non-elastic tape 76 within a double-fold 86 formed at the end of the elastic tape 74. A sewing operation, preferably double-seaming, is then performed across the width of the catch 50' near an endmost portion 88 of the double-fold 86 as shown in FIG. 8. This form of the catch is easy to manufacture and avoids the use of metal or high temperature plastic. As can be seen, the catch 50' includes a forwardly projecting lip 90 which functions in essentially the same manner as the longitudinally projecting tab 72 described in FIG. 6a.

Depending on the rigidity of the composite material forming the catch 50', a relatively thin, plastic stiffening pad 92 has been found useful in maintaining the lip 90 in a substantially forward direction as shown in FIG. 8, it having been found that in some cases the catch 50' may lack sufficient rigidity to maintain the lip 90 in the manner shown after repeated laundering of the sheet 10.

Reference is now had to FIG. 9 where the additional alternate catch 50" is illustrated as being formed by folding the single, continuous length of elastic tape 82 back upon itself in a wave-like fashion to form a fold 94 and sewing a double seam near a rearwardmost part of the fold 95. A forwardly directed, longitudinally oriented lip 96 of the catch 50" functions in the same manner as the lip 90 of the catch 50' and the tab 72 of the embodiment of the catch 50 illustrated in FIG. 6a. A relatively thin, plastic pad 98 is sandwiched in the fold of the catch 50" where additional rigidity of the catch 50" is required. It should be noted that where it is desired to use plastic stiffeners like those shown in FIGS. 8 and 9, material considerations come into play, it being necessary that the plastic be able to withstand the chemical environment and temperatures involved in laundering and ironing of the fitted sheet 10. Other methods of reinforcing the catches 50' and 50" would include, for example, addition to the area of the strip adjacent the catches 50' and 50" of a stiffening agent such as a water-insoluble coating, or the use of relatively heavy nylon reinforcing fabric sandwiched in the folds to add regidity to the lips 90 and 96.

Referring again to FIGS. 1a and 1b, it should be appreciated that when the strips 46 are relaxed within the sheaths 38, the sheet 10 can be folded easily since the sheet 10 is not gathered around a lower edge 100 of the web 16 as is the case with fitted sheets incorporating fixed elastic bands along their edges. The sheet 10 assumes an essentially box-like configuration and, when removed from the mattress 14, can be easily folded, for example, by folding the side panels 24 inwardly against the top panel 28 along the diagonal sew lines 34. Then, the remainder of the sheet 10 is folded along rectangular fold lines (not shown) in a conventional manner to form a flat, neat, and compact arrangement of the sheet 10 which can be easily stored in stacks of other like sheets 10 for ultimate use on a correspondingly dimensioned mattress 14, as described above.

Although particular embodiments of the fitted sheet 10 and its method of manufacture have been described in the foregoing detailed description, it will be understood that the invention is capable of numerous rearrangements, modifications and substitutions without departing from the scope of the invention according to what is claimed below.

What is claimed:

1. A fitted sheet for a mattress, or the like, comprising:

a web of textile material dimensioned to fittingly cover the top, ends, and sides of the mattress with an extreme free edge of said web extending below the lower edge of the mattress and extending generally around the sides and ends of the mattress;

opposed, spaced-apart sheaths extending along portions of said extreme free edge of said web, one end of each of said sheaths being open;

resiliently extensible strips located within said sheaths, each strip having one end extending out of the open end of its associated sheath and having another end anchored to the end of said associated sheath opposite the opening; and means on each of said strips adapted to slide within said sheaths when said strips are in an unstretched condition for releasably attaching each of said resiliently extensible strips to its associated sheath adjacent the opening thereof when the end of said strip extending out of the opening is resiliently extended in said sheath to locate said last mentioned means adjacent the opening of said sheath, whereby employing said last mentioned means to attach said strip to said associated sheath at the opening thereof causes the resiliency of said strip to contract said strip within its associated sheath to gather the corners of the sheet inwardly of the bottom of the mattress and to draw the sheet into fitting engagement with the mattress, said last mentioned means holding each of said strips in an extended, tensioned, configuration in its associated sheath to hold the sheet on the mattress.

2. The fitted sheet of claim 1, wherein said web of textile material comprises:

a top panel dimensioned to cover the top of the mattress;

opposed end panels extending from and continuous with said top panel, and each end panel having a lower extreme edge below the lower edge of the mattress, said end panels being dimensioned to cover the ends of the mattress and having generally triangular segments extending around the vertical corners of the mattress when the sheet is placed on a mattress to cover opposite triangular portions of the sides of the mattress; and opposed side panels extending from and continuous with said top panel, and each side panel having a lower extreme edge below the lower edge of the mattress, said side panels being dimensioned to extend across the sides of the mattress between said triangular segments of said end panels and being attached to said triangular segments.

3. The fitted sheet of claim 2, wherein said sheaths are located generally along said lower extreme edges of said opposed end panels.

4. The fitted sheet of claim 3, further comprising a perimetal edge surrounding the openings of said sheaths, said means for releasably attaching being adapted to attach said resiliently extensible strips to a portion of said perimetal edges.

5. The fitted sheet of claim 4, wherein said means for releasably attaching comprises a catch positioned at a predetermined location along each of said resiliently extensible strips, each of said catches having tabs projecting in the direction of the end of said strips anchored to said sheaths so that when said strips are extended in said sheaths to position said tabs adjacent said perimetal edges, said tabs are placed over said perimetal edges to hold said strips in a resiliently extended, tensioned, configuration in said sheaths.

6. The fitted sheet of claim 1, further comprising:

said openings of said sheaths having perimetal edges surrounding said openings; and said means for releasably attaching being adapted to attach said resiliently extensible strips along a portion of said perimetal edges.

7. The fitted sheet of claim 6, wherein said means for releasably attaching comprises catches positioned at predetermined locations along said strips intermediate opposite ends of said sheaths.

8. The fitted sheet of claim 1, wherein said means for releasably attaching comprises catches positioned at predetermined locations along said resiliently extensible strips, said catches having tabs projecting in the direction of the ends of said strips that are attached to said sheaths, the openings of said sheaths being configured to engagingly receive said tabs on a portion of the openings, so that when said strips are extended in said sheaths to a position with said tabs adjacent said opening, the tabs are engagingly received along a portion of the openings to hold said strips in a resiliently extended, tensioned, configuration.

* * * * *

UNITED STATES PATENT AND TRADEMARK OFFICE

CERTIFICATE OF CORRECTION

PATENT NO. : 4,727,608

DATED : March 1, 1988

INVENTOR(S) : William R. Joyce

It is certified that error appears in the above-identified patent and that said Letters Patent is hereby corrected as shown below: Title page:

IN THE ABSTRACT:

Line 3, "extensibile" should be -- extensible --

Column 3, line 18, after greater "then" should be -- than --

Column 4, line 38, after configured insert -- with --

Column 4, line 41, "asa" should be -- as --

Column 5, line 9, "mattres" should be -- mattress --

Column 5, line 67, "continuus" should be -- continuous --

Column 6, lines 41-42, "regidity" should be -- rigidity --

Signed and Sealed this

Twenty-ninth Day of November, 1988

*Attest:*

DONALD J. QUIGG

*Attesting Officer*

*Commissioner of Patents and Trademarks*